US005372266A

United States Patent [19]

Fisher

[11] Patent Number: 5,372,266

[45] Date of Patent: Dec. 13, 1994

[54] COLLAPSIBLE CLOTHES DRYER

[76] Inventor: Daniel R. Fisher, 1621 Norman Rd., Windsor, Ontario, Canada, N8Y-4N6

[21] Appl. No.: 116,126

[22] Filed: Sep. 2, 1993

[51] Int. Cl.[5] ..... A47F 7/00

[52] U.S. Cl. ..... 211/189; 211/119.01

[58] Field of Search ..... 211/189, 119.01, 195, 211/119.18

[56] References Cited

U.S. PATENT DOCUMENTS 2,473,047 6/1949 Bershad .
2,594,158 4/1952 Hannameyer ..... 211/119.01 X
4,434,898 3/1984 McCarthy ..... 211/119.01 X

*Primary Examiner*—Alvin C. Chin-Shue
*Assistant Examiner*—Sarah A. Lechok
*Attorney, Agent, or Firm*—Harness, Dickey & Pierce

[57] ABSTRACT

A novel open air laundry dryer including a generally rectangular free-standing frame-based structure having removably attachable pieces which can be easily assembled and disassembled by one person in about a minute. A base supports a pair of opposing side members in an upright position. Each side member includes a pair of vertical legs having a cross member extending therebetween. The vertical legs are each attachable to support bars having a plurality of article support elements such as clotheslines suspended in a spaced parallel relationship therebetween.

18 Claims, 1 Drawing Sheet

COLLAPSIBLE CLOTHES DRYER

BACKGROUND AND SUMMARY OF THE INVENTION

This invention relates generally to clothes dryers and, more particularly, to a novel open air collapsible clothes dryer.

Even with the advent of sophisticated automatic clothes dryers, there is still a demand for open air dryers from which clothes and other laundry can be hung to dry. These types of dryers remain popular for a number of different reasons. First, many clothing manufacturers continue to recommend line drying their apparel items, especially those made of delicate or shrinkage-prone fabrics. Oftentimes a clothesline is not available or practical, especially in the winter and in the instance of apartment dwellers. Those living in apartments further may wish to dry less delicate items of clothing in this fashion for other reasons such as to avoid ironing, to save the expense of coin operated drying machines and to protect more valuable items of clothing.

While this type of clothes dryer thereby provides a number of advantages, it presents one main disadvantage, namely the storage of the device. Those living in apartments may have limited space and even homeowners often need to store such devices conveniently out of sight. To provide a clothes dryer of suitable size which can also be conveniently stored, these dryers are often made to be expansible and collapsible and are often formed of pieces of tubular plastic strategically hinged together.

This type of device, however, can have several inherent disadvantages. Although lightweight, it can be flimsy and unable to support the weight of wet clothing. More sturdy devices are often heavier and can be difficult to transport or may require more than one person to assemble and disassemble. There is therefore a need for a portable collapsible open air clothes dryer which is sturdy and easily manipulated as well as which can be compacted into a convenient size and shape for storage. Such a clothes dryer also preferably should be simple and inexpensive to manufacture.

The present open air laundry dryer achieves these advantages by providing a generally rectangular, free-standing frame-based structure having removably attachable components which can be easily assembled or disassembled by one person in about a minute. A base supports a pair of opposing side members extending transversely thereabove. Each side member includes a cross member extending between a pair of vertical legs and a horizontal support bar secured to one end of each leg. An auxiliary support member is removably attachable to one of the horizontal support bars and a plurality of article support elements such as clotheslines are suspended between the auxiliary support bar and the other horizontal support bar in a spaced parallel relationship.

Additional objects, advantages, and features of the present invention will become apparent from the following description and appended claims, taken in conjunction with the accompanying drawings.

BRIEF DESCRIPTION O THE DRAWING

FIG. 1 Is an exploded perspective view of the collapsible clothes dryer of the present invention.

DETAILED DESCRIPTION OF A PREFERRED EMBODIMENT

Figure 1:
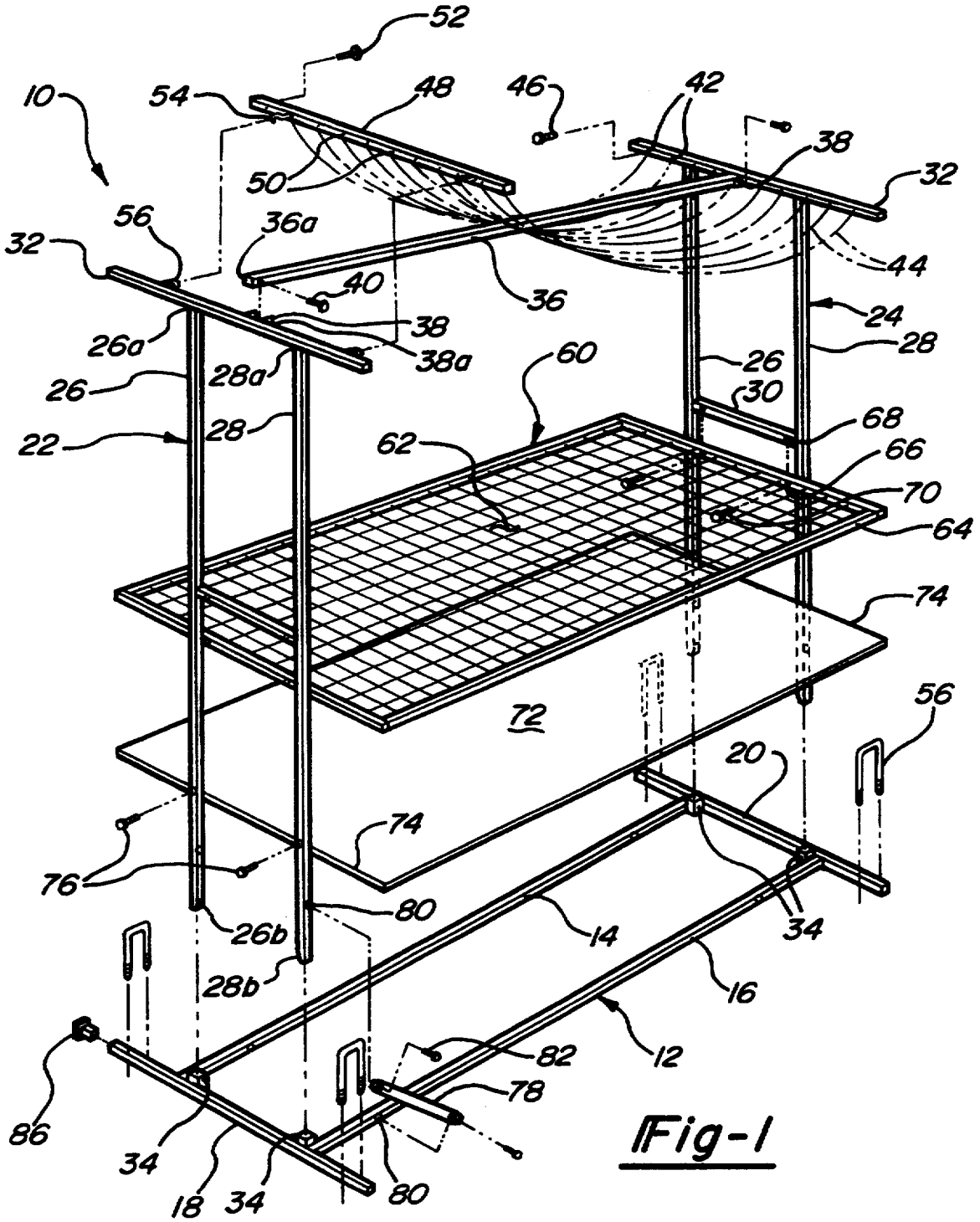

Referring now to FIG. 1, the collapsible clothes dryer of the present invention is indicated generally at 10. Dryer 10 is a substantially rectangular frame-based structure which is supported by a generally rectangular base 12 having longitudinal members 14 and 16 abutting and secured at each end to transverse members 18 and 20. Each member of base 12 is preferably formed of steel tubing which is square or rectangular in cross section, but may alternately be of other cross-sectional shape such as L-shaped, C-shaped or even flat. These members may also be formed of any other suitable material such as plastic or wood. Members 14 and 16 may be secured to members 18 and 20 by welding or other suitable means, or may alternately be integrally formed therewith.

A left side member 22 and symmetrical right side member 24 are also preferably formed of steel tubing of approximately the same cross-sectional shape and gauge as base 12. Each side 22, 24 includes a pair of legs 26 and 28 held in a parallel spaced relationship by an intermediate cross member 30. Each cross member 30 preferably extends between and is fixedly attached to legs 26 and 28 such as by welding, or may be integrally formed therewith. Each cross member 30 also preferably extends between the approximate centers of legs 26 and 28.

Extending across and atop each pair of legs 26 and 28 is a horizontal support bar 32. Each horizontal support bar 32 may be welded atop legs 26 and 28, at ends 26*a* and 28*a* thereof, or may otherwise be fixedly secured by rivets, bolts or other such fastening means known to those having skill in the art. However, horizontal support bars 32 may alternately be integrally formed with legs 26 and 28.

Positioned against base 12, adjacent an inside surface at each intersection of members 14 and 16 with members 18 and 20, is a retainer 34. Each retainer 34 preferably consists of a short section of hollow steel tubing having inside dimensions slightly larger than the outside dimensions of legs 26 and 28. Legs 26 and 28 of each side member may be slidably inserted into a corresponding retainer 34 and retentively engaged therein by a close clearance or an interference press fit so as to be supported in an upright and substantially vertical position. Ends 26*b* and 28*b* of legs 26 and 28 may additionally be tapered as shown in FIG. 1 in order to aid insertion into retainers 34.

Between horizontal support bars 32 of each side member 22, 24 extends a support beam 36. Support beam 36 adds rigidity to the overall structure of dryer 10 by maintaining a proper positional relationship between left side 22 and right side 24 across the top of the dryer 10, keeping the respective sides generally upright and parallel. Support beam 36 is likewise preferably formed of a segment of hollow steel tubing.

Support beam 36 is removably coupled between horizontal support bars 32 via generally U-shaped brackets 38 which may be welded or otherwise fixedly attached near the center of opposing surfaces of each bar 32. Brackets 38 may alternately be formed of opposing L-shaped members secured to support bars 32 a predefined distance apart or may comprise any other suitable structure otherwise configured to appropriately retain support beam 36. Suitably sized apertures or holes 36*a* and 38*a* may be provided through support beam 36 and each bracket 38, respectively, to facilitate the passage of a pin 40 or dowel therethrough. Pins 40 thereby retain each end of support beam 36 in a corresponding bracket 38.

As shown in FIG. 1, one horizontal support bar 32, shown in FIG. 1 as that bar secured to right side 24, has a plurality of spaced holes 42 formed therein for the attachment of article support means such as clotheslines 44. Clotheslines 44 are preferably made of rope, twine or other plastic or fibrous material and are preferably strong enough to support the weight of wet clothing, towels or other items without being unduly stressed or deformed thereby.

Each hole 42 preferably accepts a threaded eye bolt 46 to which a first end of a clothesline 44 may be tied or otherwise secured. However, holes 42 may pass all the way through bar 32 and lines 44 may be held in place by a suitably sized knot. One having skill in the art will readily appreciate that any number of means of attachment of lines 44 to a horizontal support bar 32 can be employed, such as eye bolts, hooks, and the like, without departure from the spirit and scope of the present invention.

The end of each line 44 opposite that secured to a bar 32 is preferably secured in a like fashion to an auxiliary line support bar 48, such as through holes 50 and eye bolts 52. Auxiliary line support bar 48 is then removably attachable to the horizontal support bar 32 attached atop left side 22 such as by hooks 54 and corresponding eye bolts 56, or any other suitable means known to those skilled in the art. Auxiliary bar 48 may also rest upon support member 36 for added support.

The length of each clothesline 44 preferably substantially corresponds to the distance between left side 22 and right side 24 so that it will be taut when bar 48 is attached to member 32. Alternately, a second auxiliary support bar similar to bar 48 could also be provided having means for attachment to the horizontal support bar 32 attached to right side member 24, with lines 44 strung between the two auxiliary support bars such as support bar 48. In this configuration, the lines and line support bars would comprise a clothesline subassembly separate from the rest of the device.

As also shown in FIG. 1, dryer 10 may additionally include a number of optional attachments, usable separately, all together or in various combinations. For instance, sturdy metal or plastic lawn pegs 56 which straddle or are otherwise securable to members 18 and 20 (or alternately members 14 and 16) may be provided for removably mounting dryer 10 to the ground or lawn when using dryer 10 outdoors. These pegs 56 provide added support for the dryer against wind or on uneven or non-level ground.

Dryer 10 may also include a sweater rack 60 having a garment support mesh 62 supported between stiffening members or by a surrounding stiffening frame 64. Mesh 62 is preferably made of nonabsorbent materials and configured so as to facilitate the passage of air therethrough to minimize the drying time of articles placed thereon. Frame 64 is preferably removably attachable to cross members 30 of side frames 22 and 24 such as by holes 66 and 68 and accompanying pins or screws 70. Alternately, rack 60 may be provided with hooks for engaging cross members 30 or any other suitable means of attachment to side members 22 and 24, such as an angle bracket 71 secured by pins or screws 70 to at least one cross member 30 or to side members 22 and 24. In this regard, rack 60 could be supported by a pair of opposed angle brackets 71.

A waterproof drop sheet 72 may also be provided, especially for in-home use of dryer 10, to catch water dripping from drying clothes. Drop sheet 72 is preferably made of a plastic or waterproof canvas stretched between a pair of stiffening members 74. Drop sheet 12 may be secured to a lower portion of legs 26 and 28 of each side 22 and 24 such as by affixing stiffening members 74 to legs 26 and 28 with pins or dowels 76 or by resting upon one or more angle brackets 71.

Dryer 10 may further include one or more diagonal braces 78 adapted to be connected between vertical legs 26 and 28 and base 12, such as by appropriately positioned holes 80 and pins or dowels 82. These diagonal braces 78 provide increased rigidity, especially in dryers made relatively larger in size or when drying items which are heavy when wet.

Plastic end caps 86 may additionally be provided as needed to cover cut or unfinished edges of sections of steel tubing forming base 12, sides 22 and 24, and members 32, 36 and 48, in order to provide a finished and neat appearance. These tubular steel members of dryer 10 are also preferably painted or plastic coated for the same reason.

While the dryer 10 of the present invention may vary in size depending on the strength of its supporting structure, sides 22 and 24 stand preferably about five feet high when attached to base 12, members 14 and 16 of base 12 are preferably about five feet long and members 18 and 20 preferably three feet long. These dimensions allow items of clothing to be conveniently hung on hangers from lines 44 or otherwise draped thereover. These dimensions also allow sweaters or other items to be laid flat on rack 60 when drying. They also provide a dryer which can be compacted for storage into a five feet by three feet by four inch space so as to be easily stored beneath a bed.

As shown in FIG. 1, to disassemble dryer 10 the optional sweater rack 60 and drop sheet 72 are first removed. Auxiliary support member 48 may then be disengaged from left side support bar 32. Support beam 36 is also unattached from left side 22 via removal of a pin 40. Support beam 36 may be left to pivot about that pin 40 attaching it to the support bar 32 attached to right side 24 or may be completely removed therefrom. Side frames 22 and 24 are removed from base 12 by pulling vertical legs 26 and 28 upwardly out of retainers 34. The various pieces may then be stacked and stored flat. A box or other means may also be provided in conjunction with dryer 10 for storing the main components and/or smaller components such as pins, lawn pegs 56 and braces 82 therein. Assembly of dryer 10 may be easily performed in a reverse sequence.

Dryer 10 thereby provides distinct advantages not provided with previous dryers of this type. Dryer 10 is sturdy yet lightweight and can be readily disassembled for convenient storage and reassembled for use. Optional features allow items to be dried flat and facilitates use both indoors and out. Components made of sections of steel tubing allow for easy and inexpensive manufacture.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A collapsible clothes dryer comprising:

a supporting base;

a pair of spaced opposing side members, each side member including a cross member extending between a pair of spaced legs and a horizontal support bar fixedly attached to one end of each said leg;

retainer means for removably securing each said leg to said base, said legs being supported with respect to said base in an upright substantially vertical position;

an auxiliary support bar removably attachable to one of said horizontal support bars; and a plurality of garment support elements suspended in a spaced parallel relationship between one of said horizontal support bars and said auxiliary support bar.

2. The dryer of claim 1 wherein said base, side members and support bars are tubular members.

3. The dryer of claim 1 wherein said retainer means comprise sections of tubing secured to said base, said sections having an inside dimension slightly larger than that of the outside dimension of said legs wherein said legs are retained in said retainer means by an interference press fit.

4. The dryer of claim 3 wherein said base comprises a pair of longitudinal members attached to a pair of transverse members, said retainer means comprising retainers being disposed on an inside surface of said base adjacent one said transverse member and one said longitudinal member.

5. The dryer of claim 2 wherein said tubular members are generally rectangular in cross section.

6. The dryer of claim 1 further comprising a support beam removably attached to each of said horizontal support bars and extending perpendicularly therebetween.

7. The dryer of claim 1 further comprising sheet means suspendable in a substantially horizontal position between said side members.

8. The dryer of claim 7 wherein said suspendable sheet means is removably securable to said cross members.

9. The dryer of claim 1 wherein at least one said garment support element comprises a clothesline.

10. The dryer of claim 1 further comprising at least one brace removably attachable between said base and one of said legs.

11. A collapsible clothes dryer comprising:

a supporting base including a pair of longitudinal members fixedly secured to a pair of transverse members;

a pair of spaced opposing side members, each side member including a cross member extending between a pair of vertically disposed legs and a horizontal support bar fixedly secured to one end of each said leg;

an auxiliary support bar removably attachable to one of said horizontal support bars;

a plurality of retainers fixedly attached to said base, each said retainer adapted to retentively engage one of said legs to support said side members with respect to said base in an upright substantially vertical position;

a plurality of clotheslines suspended in a spaced parallel relationship between one said horizontal support member and said auxiliary support member; and a support beam removably attached to each said horizontal support member and disposed perpendicularly therebetween.

12. The dryer of claim 11 wherein said base, side members and support bars are tubular.

13. The dryer of claim 11 wherein said retainers comprise sections of tubing secured to said base, said tubular sections having inside dimensions slightly larger than the outside dimensions of said legs wherein said legs are retained in said retainers by an interference press fit.

14. The dryer of claim 12 wherein said tubular sections are substantially rectangular in cross section.

15. The dryer of claim 11 wherein said retainers are disposed on an inside surface of said base adjacent one said transverse member and one said longitudinal member.

16. The dryer of claim 11 further comprising sheet means suspendable in a substantially horizontal position between said side members.

17. The dryer of claim 16 wherein said suspendable sheet means is removably securable to each of said cross members.

18. The drier of claim 11 further comprising at least one brace removably attachable between said base and one of said legs.

* * * * *